United States Patent [19]

Tanaka

[11] Patent Number: 4,911,838

[45] Date of Patent: Mar. 27, 1990

[54] PLURI-TUBULAR AERATOR

[75] Inventor: Hideki Tanaka, Hyogo, Japan

[73] Assignee: Kabushiki Kaisha Kobe Seiko Sho, Kobe, Japan

[21] Appl. No.: 312,302

[22] Filed: Feb. 17, 1989

Related U.S. Application Data

[63] Continuation of Ser. No. 116,966, Nov. 5, 1987, abandoned.

[30] Foreign Application Priority Data

Feb. 27, 1987 [JP] Japan ..... 62-29550[U]
Feb. 27, 1987 [JP] Japan ..... 62-29552[U]
Sep. 2, 1987 [JP] Japan ..... 62-219716

[51] Int. Cl.[4] ..... B01F 3/04

[52] U.S. Cl. ..... 210/221.2; 210/242.2; 261/77; 261/120

[58] Field of Search ..... 210/170, 221.1, 242.2, 210/221.2; 261/77, 75, 120

[56] References Cited

U.S. PATENT DOCUMENTS 3,246,761 4/1966 Bryan et al. ..... 261/77
3,592,450 7/1971 Rippon ..... 261/123
3,628,775 12/1971 McConnell et al. ..... 261/121.1
4,169,873 10/1979 Lipert ..... 261/77
4,187,263 2/1980 Lipert ..... 261/77
4,293,506 10/1981 Lipert ..... 261/77
4,436,675 3/1984 Hisao et al. ..... 261/77
4,549,997 10/1985 Verner et al. ..... 261/124
4,569,804 2/1986 Murphy ..... 261/77
4,702,830 10/1987 Makino et al. ..... 261/77
4,707,308 11/1987 Ryall ..... 261/77
4,752,421 6/1988 Makino ..... 261/261

FOREIGN PATENT DOCUMENTS 2355463 5/1975 Fed. Rep. of Germany ... 210/242.2
58-137900 9/1983 Japan .
60-176300 11/1985 Japan .

*Primary Examiner*—Richard V. Fisher
*Assistant Examiner*—Coreen Y. Lee
*Attorney, Agent, or Firm*—Oblon, Spivak, McClelland, Maier & Neustadt

[57] ABSTRACT

A pluri-tubular aerator includes a vertical central tube member, at least one outer tube member disposed concentrically around said central tube member, and at least one of an diffuser and an air tank disposed on an lower end of the aerator for delivering externally supplied air into the central tube member or a space between the central and outer tube members. The diffuser produces a continuous stream of fine air bubbles while the air tank intermittently produces a bulky air bubble of either a spherical shape or a ring-shape. Preferably, the diffuser and the air tank are used concurrently.

4 Claims, 13 Drawing Sheets

PLURI-TUBULAR AERATOR

This application is a continuation of application Ser. No. 07/116,966, filed on Nov. 5, 1987, now abandoned.

BACKGROUND OF THE INVENTION

1. Field of the Invention:

The present invention relates to pluri-tubular aerators suitable for use in the modification of the quality of water in reservoirs such as lakes, ponds or dams, or in harbors.

2. Description of the Prior Art:

In the modification of the quality of water in a lake, for example, it has been customary practice to interchange the surface water of a high dissolved oxygen content with the bottom water of a low dissolved oxygen content for activating the bottom of the lake, thereby purifying the water in the lake.

In order to circulate the lake water, there have been proposed two types of aerators; one being a continuous aerator, the other being an intermittent aerator.

A typical example of known continuous aerator, as shown in FIG. 11 of the accompanying drawings, includes a single uptake tube 1 disposed vertically on the bottom of a lake, and a diffuser 2 disposed in the uptake tube 1 adjacent to the lower end thereof.

Upon receipt of a supply of compressed air, the diffuser 2 produces a stream of fine air bubbles 3 rising in and along the uptake tube 1. In this instance, a large amount of oxygen is dissolved into the water, and due to the rising air bubbles 3, water is moved upwardly at a constant flow velocity, as shown in FIG. 12, circulating throughout the depth of the lake. With this circulation, the dissolved oxygen content in the bottom water is substantially increased with the result being that the bottom of the lake is activated to thereby prevent dissolution of iron, manganese, phosphorus, nitrogen or the like from the bottom of the lake, and also enable inhabitation of aquatic life.

The continuous aerator of the foregoing construction is advantageous in that an increased amount of dissolved oxygen is obtained. This aerator however has a drawback in that the effective aeration area is narrow and sufficient circulation and agitation of lake water is difficult to obtain.

One example of intermittent aerator, as shown in FIG. 13, includes an uptake tube 4 and a tank 5 disposed at a lower portion of the uptake tube 4 for intermittently producing bulky air bubbles 6 rising in and along the uptake tube 4 for lifting water layers disposed between adjacent bulky air bubbles 6 (Japanese Utility Model Laid-open Publication No. 58-137900, for example).

With this construction, water sealed between adjacent air bubbles is drafted or lifted reliably at a high speed so that as shown in FIG. 14, water is continuously drafted due to inertia even after the arrival of a bulky air bubble at the surface of the lake. As a result, the lift of water relative to the supply of air is greater than that of the continuous aerator. The intermittent aerator of this type however has a drawback in that only a limited effect is obtained for increasing the dissolved oxygen content.

The lift of water per unit air supply varies with the cycle of production of the bulky air bubbles which is determined by the air supply per unit time. It is therefore desirable to select the capacity of a compressor such that compressed air is supplied to the tank at maximum efficiency. In practice, however, when an optimum air supply per unit time is to be 0.7 $m^3$/min, a compressor having a capacity of 7.5 KW (0.84 $m^3$/min) is generally employed in view of allowance, rather than a compressor having a capacity of 5.5 KW (0.63 $m^3$/min).

With this oversized compressor, a subsequent bulky air bubble is produced even when water is still rising under inertia, and hence the use of the inertial force is substantially limited as shown in FIG. 15. Consequently, despite a slight increase of the lift of water obtained, the lift of water relative to the amount of air supply decreases conversely and hence the efficiency of the aerator is lowered as a whole.

The foregoing intermittent aerator having a single uptake tube is relatively small in size and hence ten or more of such small aerators are used for a sufficient circulation of water when the pondage of a lake to be treated is relatively large. However, a lake having a pondage greater than 8 million ton requires a number of such single uptake tube aerators. This system is expensive and hence the small-sized single uptake tube aerator is not used so widely.

With the foregoing difficulties in view, various attempts have been taken to increase the capacity of the conventional intermittent uptake tube aerator, which capacity has been limited by the size of an air bubble formed under water. It has been acknowledged that the maximum diameter of the air bubbles is limited to 500 mm–600 mm and when in an uptake tube having an inside diameter greater than this maximum bubble diameter, produced bubbles are separated into several bulky air bubbles. Such separated air bubbles are no longer effective to seal the inside of the uptake tube and hence the lifting ability is substantially reduced.

According to one proposal disclosed in Japanese Utility Model Laid-open Publication No. 60-176300, there is provided an aerator which includes, as reillustrated here in FIGS. 16A and 16B, a plurality of tubes having an inside diameter of 500 mm–600 mm for providing a corresponding number of maximum air bubbles to thereby increase the lift of water.

The proposed aerator is called a bundle type and is composed of a lower tube 7 having a tank 8 for producing bulky air bubbles 9 (only one shown in FIG. 16A), and four uptake tubes 10 disposed on the top of the lower tube 7. In operation, compressed air supplied by an external source is introduced through an inlet 8*a* into the tank 8. The compressed air fills the tank 2 soon and then is drawn into the interior of the lower tube 7 instantaneously under siphonage, thereby producing a single bulky air bubble 9. The air bubble 9 then rises in and along the lower tube 7 and upon its arrival at the uptake tubes 10, the air bubble 9 is divided into four air bubbles 9' which in turn separate inside water into upper and lower parts and move these water parts upwardly as they rise in and along the uptake tubes.

Thus, the bottom water in the lake is intermittently lifted by means of the buoyancy of the air bubbles.

Since the lower tube 7 of the foregoing large-sized intermittent uptake tube aerator has a large inside diameter such as 1 m, for example, the air bubble 9 produced therein tends to be separated into a plurality of small bubbles due to the effect of the surface tension and the buoyancy. In this case, the air bubble 9 is not delivered evenly into the four uptake tubes 10 and the air bubbles thus distributed are not uniform in size. With this. non-uniformity, an undersized air bubble 9' fails to separate the inside water into upper and lower parts for sealing the corresponding uptake tube 10 with the result being that the lift of water is substantially lowered. As is apparent from the foregoing description, multiplying the number of uptake tubes does not necessarily bring about a corresponding increase in the lift of water. With this difficulty, an intermittent uptake tube aerator of a large capacity has not been realized.

SUMMARY OF THE INVENTION

It is accordingly a general object of the present invention to overcome or substantially eliminate the foregoing drawbacks of the prior art aerators.

A more specific object of the present invention is to provide a pluri-tubular aerator incorporating structural features which provide an increased lift of water without lowering the aeration efficiency.

According to the present invention, a pluri-tubular aerator includes a vertical central tube member, at least one outer tube member disposed concentrically around said central tube member, and at least one of an diffuser and an air tank disposed on an lower end of the aerator for delivering externally supplied air into the central tube member or a space between the central and outer tube members. The diffuser produces a continuous stream of fine air bubbles while the air tank intermittently produces a bulky air bubble of either a spherical shape or a ring-shape. Preferably, the diffuser and the air tank are used concurrently.

Many other advantages and features of the present invention will become manifest to those versed in the art upon making reference to the detailed description and the accompanying sheets of drawings in which preferred structural embodiments incorporating the principles of the present invention are shown by way of illustrative example. In the drawings, like reference characters refer to like or corresponding parts throughout the several views.

DESCRIPTION OF THE PREFERRED EMBODIMENT

Figure 1:
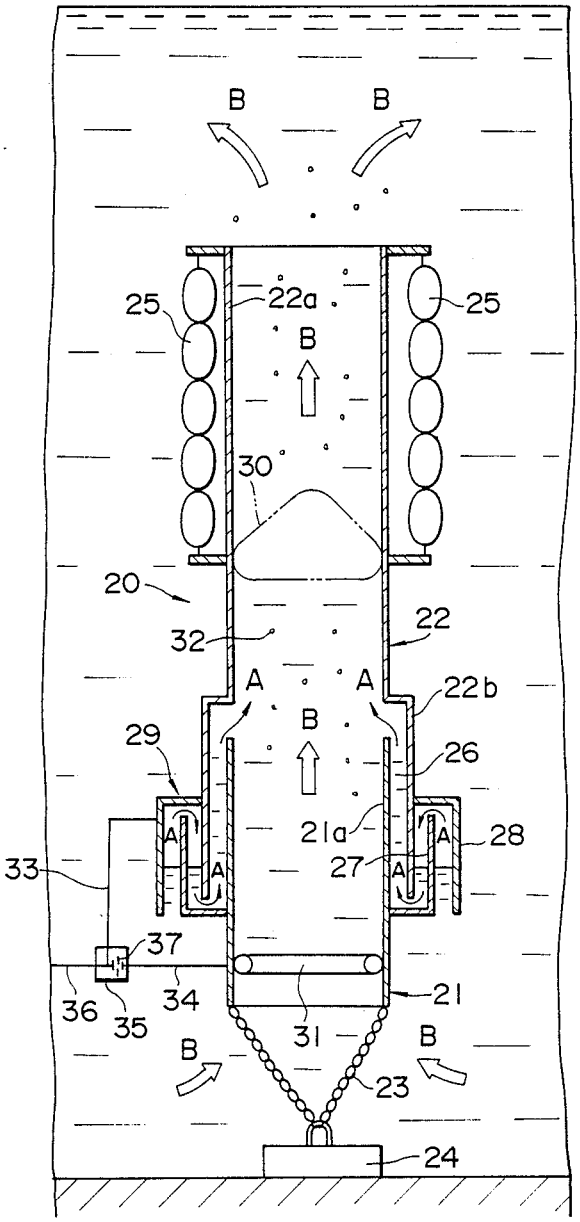
FIG. 1 is a schematic vertical cross-sectional view of a single-tubular aerator embodying the present invention.

FIG. 1 shows a first embodiment of aerator according to the present invention. The aerator comprises a double tubular uptake tube 20 composed of an inner tube member 21 and an outer tube member 22 joined together in concentric relation to one another. The inner tube member 21 is connected at its lower end with an anchoring chain 23 secured to a sinker 24 disposed on the bottom of a lake. The outer tube member 22 is provided with a plurality of floats 25 disposed around an upper portion 22*a* of the outer tube member 22 so that the uptake tube 20 is vertically disposed in the water. The lower portion 22*b* of the outer tube member 22 is enlarged and extends parallel along an upper portion 21*a* of the inner tube member 21, with a hollow annular or cylindrical channel 26 defined between the lower and upper portions 22*b*, 21*a*. The upper portion 21*a* of the inner tube member 21 is connected with a bottomed tubular member 27 extending concentrically around the lower portion 22*b* of the outer tube member 22 with a predetermined space formed therebetween. Likewise, the lower portion 22*b* is connected with a topped tubular member 28 extending concentrically around the bottomed tubular member 27 and joined with the latter, with a predetermined space formed between the tubular members 27, 28. The upper and lower portions 21*a*, 22*b* and the tubular portions 27, 28 jointly constitute an air tank 29 for intermitently producing bulky air bubbles 30. A diffuser 31 is disposed in the inner tube member 21 adjacent to the lower end thereof and extends along the inner peripheral wall of the tube member 21 for producing fine bubbles 32.

The tank 29 and the diffuser 31 are connected respectively with a pair of air pipes 33, 34 which are in turn connected with a distributing means 35. The air pipe 33 is connected directly with an air supply pipe 36 while the air pipe 34 is connected with the air supply pipe 36 via an orifice 37 provided in the distributing means 35. The distributing means 35 is so constructed as to distribute externally supplied compressed air in such a manner that a major part of the compressed air supply, which amounts to the maximum lifting efficiency, is delivered to the tank 29 and the rest of the compressed air supply is delivered through the orifice 37 to the diffuser 31.

With the aerator thus constructed, compressed air is supplied from a non-illustrated external source successively through the air supply pipe 36, the distributing means 35, and the air pipe 33 to the tank 29. The compressed air is stored in the topped tubular member 28 and the water level in the tubular member 28 is lowered gradually with an increase in the amount of compressed air. When the water level in the tubular member 28 reaches the lower end of the upper tube member 22, compressed air is instantaneously drawn under siphonage through the annular channel 26 into the interior of the upper portion 22*a* of the outer tube member 22, as indicated by the arrows A.

A single bulky air bubble 30 is thus produced in the uptake tube 20. As the air bubble 30 rises along the upper portion 22*a* of the outer tube member 22, upper and lower water parts separated by the air bubble 30 are moved upwardly. Consequently, the bottom water is thrust upward to and agitated with the surface water of a high dissolved oxygen content, as indicated by the arrows B. With this agitation, the bottom water is activated and waterweeds are conveyed from the surface to the bottom of the lake.

Figure 2:
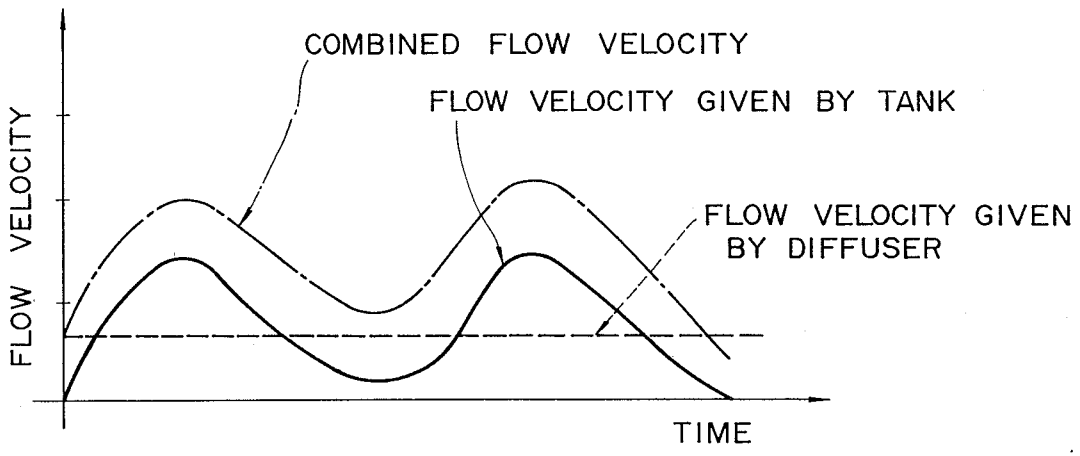
FIG. 2 is a graph showing the flow velocity of water lifted by the aerator shown in FIG. 1.

The foregoing lifting operation by the bulky air bubble 30 is repeated with a cycle time ranging from about 15 seconds to about one minute. During that time, the diffuser 31 receives the remainder of the compressed air supply left when the major part is being delivered to the tank 29 as described above. The diffuser 31 continuously produces fine air bubbles 32 so that a large amount of oxygen is dissolved into the water as the latter flows through the inner and outer tube members 21, 22 of the uptake tube 20. The rising fine air bubbles 12 also function to lift the water with the result being that the flow velocity of the lifted water is increased by a constant value which is obtained by the diffuser 31 additional to the flow velocity given by the bulky air bubble producing tank 29, as shown in FIG. 2.

The amount of compressed air delivered by the distributing means 35 may be set to a predetermined constant valve instead of a margin of the compressed air supplied to the tank 29. It is also possible to feed the compressed air to the tank 29 and the diffuser 31 via a pair of flow control valves (not shown), respectively. The distributing means 35 may be set to deliver all the compressed air supply to the tank 29 when the maximum lift of water is necessary. Conversely, it may be set to deliver all the compressed air supply to the diffuser 31, thereby increasing the dissolved oxygen level.

Figure 3:
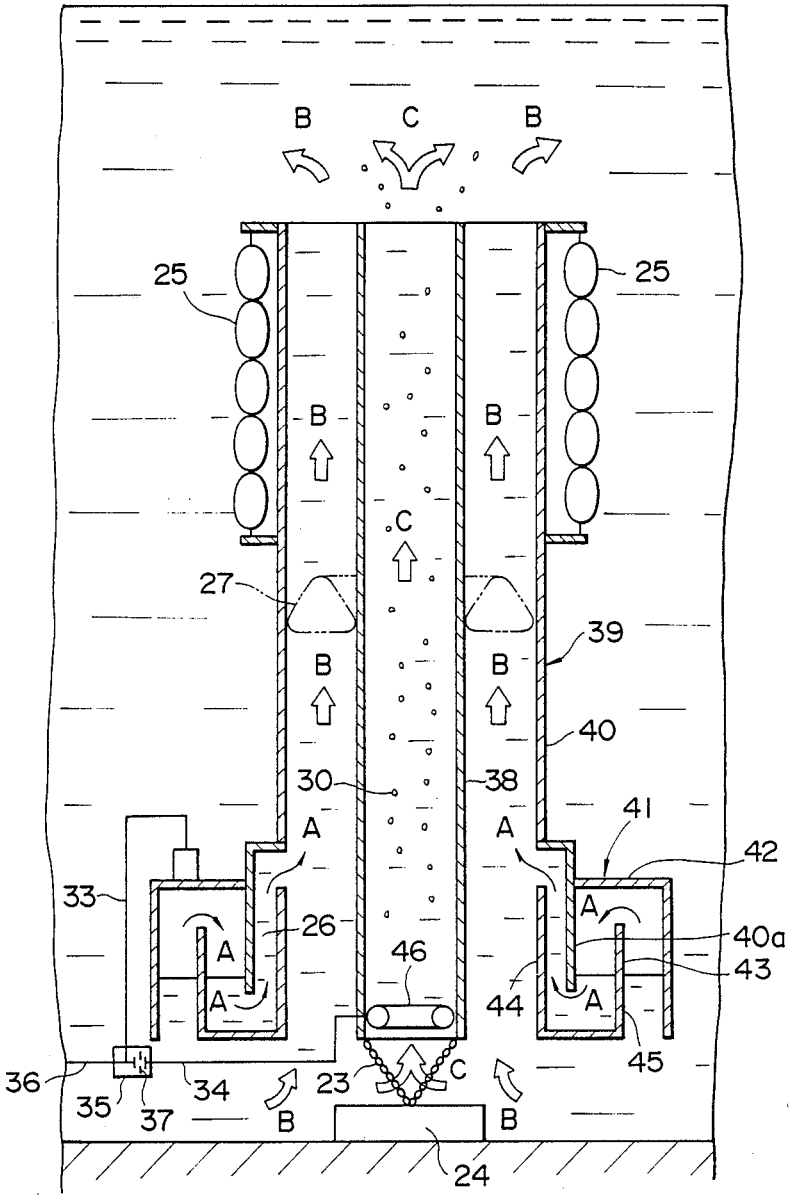
FIG. 3 is a view similar to FIG. 1, but showing a double-tubular aerator.
Figure 4:
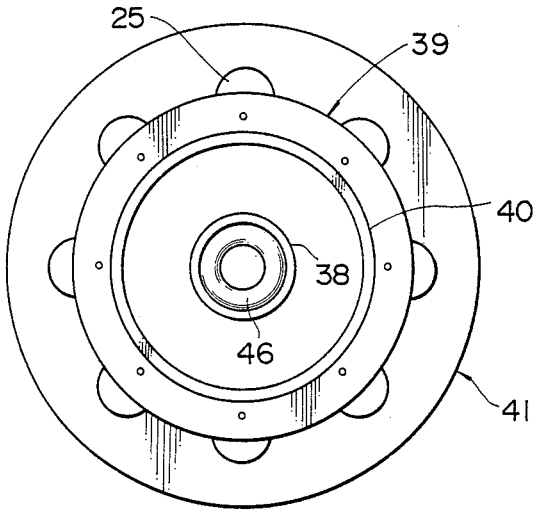
FIG. 4 is a plan view of the aerator shown in FIG. 3.

A modified aerator shown in FIGS. 3 and 4 is similar to the aerator 22 of the foregoing embodiment but differs therefrom in that the inner tube member 38 of a double tubular uptake tube 39 has substantially the same length as the outer tube member 40 and the spacing between the inner and outer tube members 38, 40 is slightly smaller than the inside diameter of the inner tube member 38. A bulky air bubble producing tank 41 is disposed concentrically around a lower end portion 40*a* of the outer tube member 40. The tank 41 is composed of a topped tubular member 42 joined with the outer tube member 40, and a double tubular member 43 joined with the topped tubular member 42 with its opposite inner and outer peripheral walls 44, 45 extending respectively between the inner tube member 38 and the outer tube member 40 and between the outer tube member 40 and the peripheral wall of the tubular member 42. A diffuser 46 is disposed in the inner tube member 38 adjacent to a lower end thereof. Other structural details are the same as those in the foregoing embodiment shown in FIG. 1 and hence will require no further description.

With the double tubular uptake tube aerator thus constructed, compressed air is supplied through an air supply pipe 36, the distributing means 35 and the air pipe 33 into the tank 41. The compressed air stored in the topped double tubular member 42 progressively lowers the water level in the tank 41. When the water level becomes equal to the lower end of the outer tube member 40, compressed air is instantaneously drawn through an annular channel 26 into an annular space between the inner and outer tube members 38, 40. Thus, a bulky torus or ring-shaped air bubble 47 is produced in the outer tube member 40. The ring-shaped air bubble 47 is unlikely to be separated even when the inside diameter of the outer tube member 40 is increased to a certain extent. With this ring-shaped air bubble 47 thus produced, a large lifting of water is obtainable. At the same time, a number of fine bubbles 30 are produced by the diffuser 46 so that a large amount of oxygen is dissolved into the water in the inner tube member 30. The water of a high dissolved oxygen content flows upwardly as the fine air bubbles rises along the inner tube member 38, as indicated by the arrows C. The water of high dissolved oxygen content is then mixed up with the water lifted by the bulky ring-shaped air bubble 44 in the vicinity of the upper end of the uptake tube 39. The aerator of this embodiment is advantageous over the aerator of the first-mentioned embodiement in that a large effective aeration area is obtained.

Figure 5:
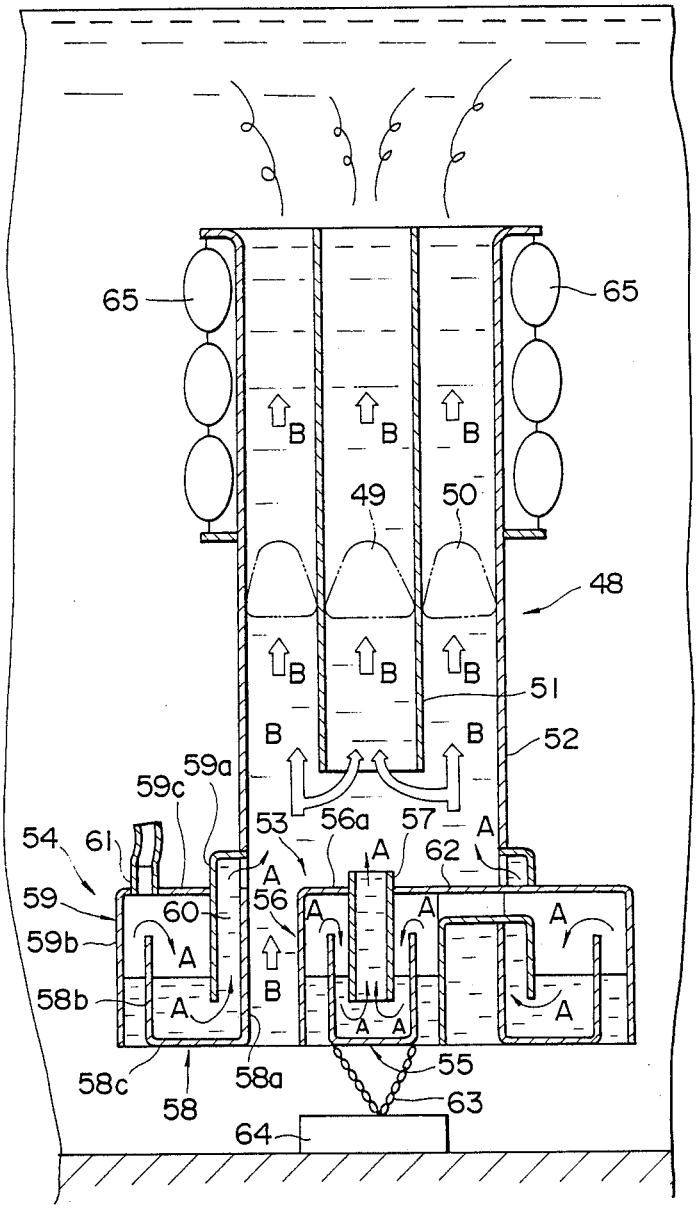
FIG. 5 is a schematic vertical cross-sectional view of another modified aerator.
Figure 6:
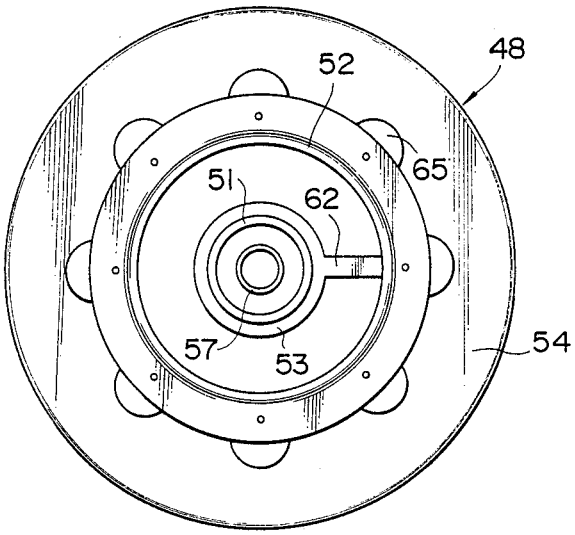
FIG. 6 is a plan view of the aerator shown in FIG. 5.
Figure 7:
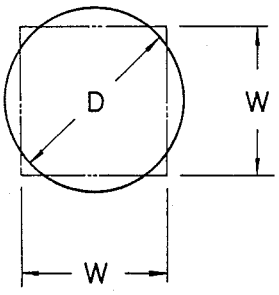
FIGS. 7 and 8 are diagrammatic views illustrative of the dimensional relationship between the diameter of an inner tube member and the distance between the inner tube member and an outer tube member of the aerator shown in FIG. 5.
Figure 8:
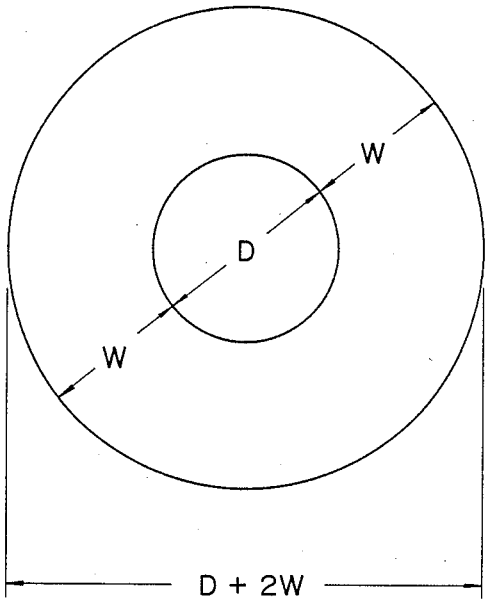
Figure 9:
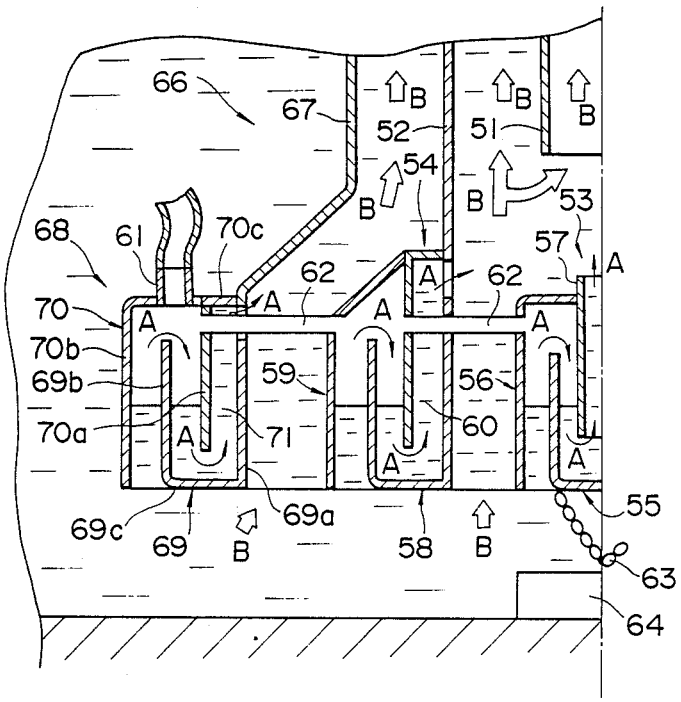
FIG. 9 is a fragmentary vertical cross-sectional view of an aerator according to another embodiment.

FIGS. 5 and 6 show a modified uptake tube aerator 48 so constructed to produce two kinds of bulky air bubbles 49, 50 for lifting the lake water. The uptake tube aerator 48 includes a vertically extending central tube member 51 and an outer tube member 52 disposed concentrically around the central tube member 51. The central tube member 51 has an inside diameter D set in a range of from about 500 mm to about 600 mm for enabling reliable formation of a single air bubble on the effect of the surface tension and the buoyancy. Likewise, the space or distance W between the central and outer tube members 51, 52 is determined by the equation: $W \approx 0.8.D$ for the formation of a single air bubble. As shown in FIGS. 7 and 8, the distance W is nearly equal to the length of one side of a cube whose volume is the same as the volume V of a sphere or ball having the diameter D, i.e.

$$v = \pi/6 \cdot D^3 \text{ and}$$

$$W = \sqrt[3]{\pi/6} \cdot D \approx 0.8 \cdot D$$

The uptake tube aerator 48 also includes an inner air tank 53 for producing one of the bulky air bubbles 49 in the central tube member 51, and an outer air tank 54 for producing the other bulky air bubble 50 between the inner and outer tube members 51, 52, both tanks 53, 54 being connected to a lower end of the outer tube member 52.

The inner tank 53 includes a bottomed tubular member 55 disposed beneath the central tube member 51 in concentric relation thereto, a topped tubular member 56 disposed around the bottomed tubular member 55 with a predetermined space leaving therebetween, and a vertical first connecting pipe 57 extending centrally through a top wall 56*a* of the tubular member 56 to connect the interior of the bottomed tubular member 55 in fluid communication with a lower interior portion of the central tube member 51.

The outer tank 54 is disposed cencentrically around the inner tank 53 and includes a bottomed double tubular member 58 and a topped double tubular member 59 disposed concentrically around the bottomed double tubular member 58. The bottomed double tubular member 58 is composed of a pair of parallel spaced inner and outer tubes 58*a*, 58*b* joined together by an annular bottom wall 58*c*. Likewise, the topped double tubular member 59 is composed of a pair of parallel spaced inner and outer tubes 59*a*, 59*b* disposed respectively around the inner and outer tubes 58*a*, 58*b* with a pair of predetermined annular spaces leaving between the inner tubes 58*a*, 59*a* and between the outer tubes 58*b*, 59*b*. The inner and outer tubes 59*a*, 59*b* are connected together by an annular top wall 59*c*. The annular space 60 which is defined between the inner tubes 58*a*, 59*a* is connected at its upper end with a lower interior space in the outer tube member 52.

The top wall 59*c* of the double tubular member 59 has an inlet 61 through which compressed air is supplied into the tanks 53, 54. A horizontal second connecting pipe 62 is connected at its one end with the topped double tubular member 59 adjacent to the top wall 59*c*, the other end of the connecting pipe 62 being connected to the topped tubular member 56 adjacent to the top wall 56*a*, with the result being that the inner and outer tanks 53, 54 are connected in fluid communication with each other.

The bottomed tubular member 55 of the inner tank 53 is connected with an anchoring chain 63 which in turn is connected to a sinker 64 fixed to the bottom of the lake. The outer tube member 52 carries therearound a plurality (e.g. eight in the illustrated embodiment) of rows of floats 65 circumferentially spaced at equal intervals, so that the uptake tube aerator 48 is upstanding in the water.

With this construction, when compressed air is supplied through the inlet 61 into the outer and inner tanks 53, 54, the supplied compressed air is stored in an upper interior part of each of the topped tubular members 56, 59. Then the water levels in the respective tubular members 56, 59 are progressively lowered as the amount of storage of compressed air increases. A further increase in the compressed air storage causes the water levels to lie flush with the lower ends of the first connecting pipe 57 and the inner tube 59*a* whereupon the compressed air is instanteneously drawn under siphonage from the tanks 53, 54 through the connecting pipe 57 and the annular space 60 into a lower end portion of the outer tube member 52.

Thus a generally conical, bulky air bubble 49 and a ring-shaped bulky air bubble 50 are produced respectively in the central tube member 51 and between the central and outer tube members 51, 52. As the bulky air bubbles 49, 50 rise along the uptake tube aerator 48, upper and lower water parts disposed on opposite sides of the respective air bubbles 49, 50 are moved upwardly. Consequently, the bottom water is activated as it is thrust upward against the surface of the lake and agitated with the surface water having a high dissolved oxygen level, as indicated by the arrows B. During that time, the compressed air is stored in the inner and outer tanks 53, 54 and then the stored air is drawn from the tanks 53, 54 into the inner and outer tube members 51, 52 for producing the next succeeding air bubbles 49, 50 in the same manner as described above.

Since the inside diameter D of the central tube member 51 and the distance W between the central and outer tube members 51, 52 are set to be in the afore-said relation, the bulky air bubbles 49, 50 are movable upwardly along the uptake tube 48 without subdivision or breakage. The water is therefore completely separated by the bulky air bubbles 49, 50 and hence is lifted positively with the upward movement of the bulky air bubbles 49, 50.

As a consequence of the foregoing setting of the inside diameter D of the central tube member 51 and the distance W between the central and outer tube members 51, 52, the inside diameter D′ of the outer tube member 52 is obtained by the following equation: $D'=D+2W=2.6.D$ The ratio of the amount of air $V_2$ obtained in this case to the amount of air $V_1$ obtained in a single uptake tube is obtained by the following equation:

$$\frac{V_2}{V_1} = \frac{\pi/4\,(D'^2 - D^2) \times W}{\pi/6 \cdot D^3} = 6.9$$

This means that the lift of the uptake tube aerator 48 of the double tubular construction is about 6.9 times as greater as the lift obtained by the single uptake tube aerator.

The number of the outer tube member is not limited to one, and two or more of such outer tube member may be used in an aerator, as shown in FIG. 7. The aerator 66 shown in FIG. 7 is similar to the aerator 48 of FIG. 5 but differs therefrom in that a second outer tube member 67 is disposed concentrically around the outer tube member 52, and a second outer air tank 68 is disposed concentrically around the outer air tank 54. Like the outer tank 54, the second outer tank 68 includes a bottomed double tubular member 69 and a topped double tubular member 70 disposed concentrically around the bottmed double tubular member 69. The bottomed double tubular member 69 is composed of a pair of paralled spaced inner and outer tubes 69*a*, 69*b* connected together by an annular bottom wall 69*c*. The topped double tubular member 70 is composed of a pair of parallel spaced inner and outer tubes 70*a*, 70*b* disposed respectively around the inner and outer tubes 69*a*, 69*b* with predetermined annular spaces formed therebetween, and an annular top wall 70*c* interconnecting the inner and outer tubes 70*a*, 70*b*. The annular space 71 which is defined between the inner tubes 69*a*, 70*a* is connected at its upper end with a lower interior portion of the second outer tank member 67.

With this concentric arrangement of the multiple tubular members, the amount of lift is positively increased. In the illustrated embodiment, the tanks 53, 54, 68 are interconnected by the connecting pipes 62. However, the present invention is not limited to such specifically described embodiment. It is possible, according to the present invention, to feed compressed air directly and independently to the respective tanks 53, 54, 68 out of synchronism with each other. Furthermore, the number of the tanks may not be the same as the number of the tube members and a lesser number of tanks may be used as long as a reliable formation of the bulky air bubbles is guaranteed in each tube member.

Figure 10:
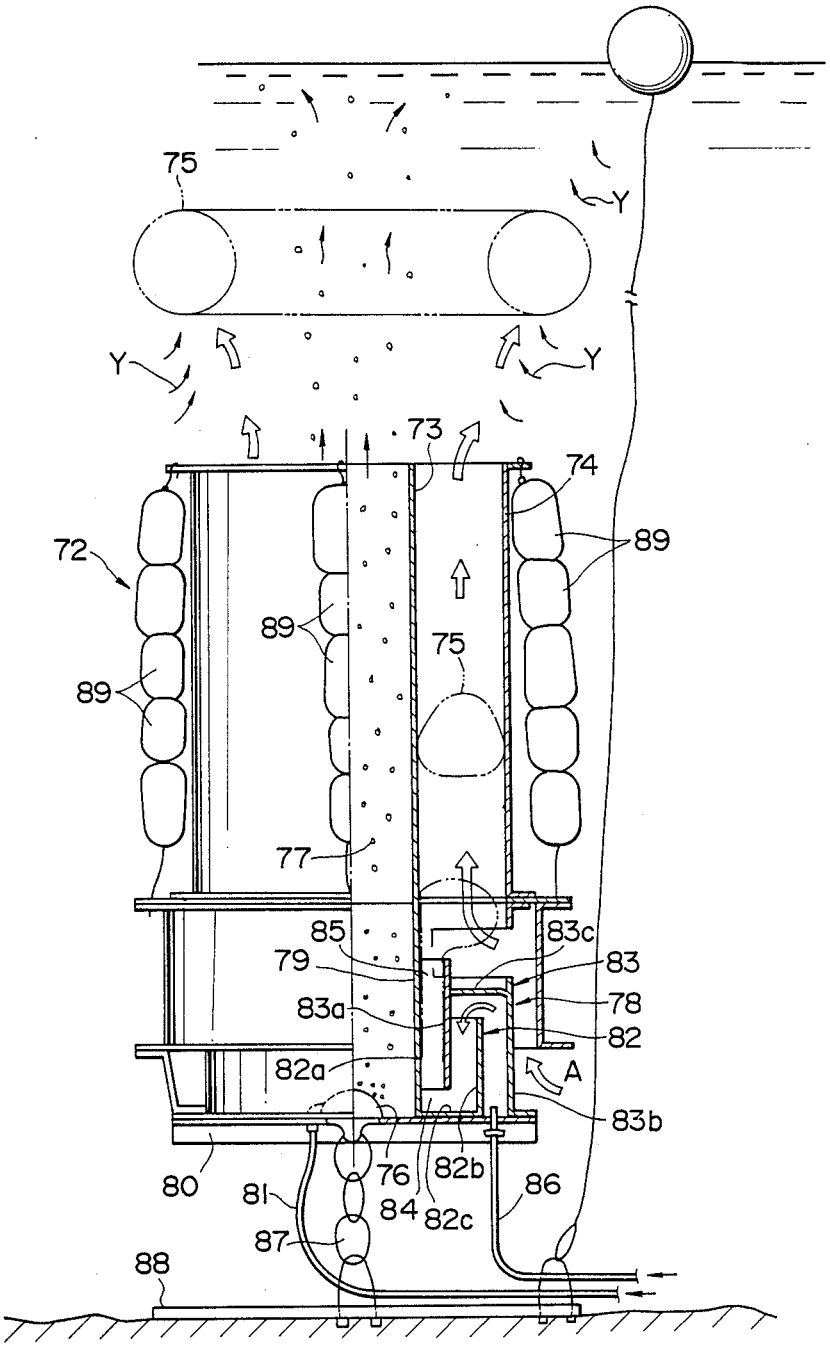
FIG. 10 is a front elevational view, partly in cross section, of a modified aerator.
Figure 11:
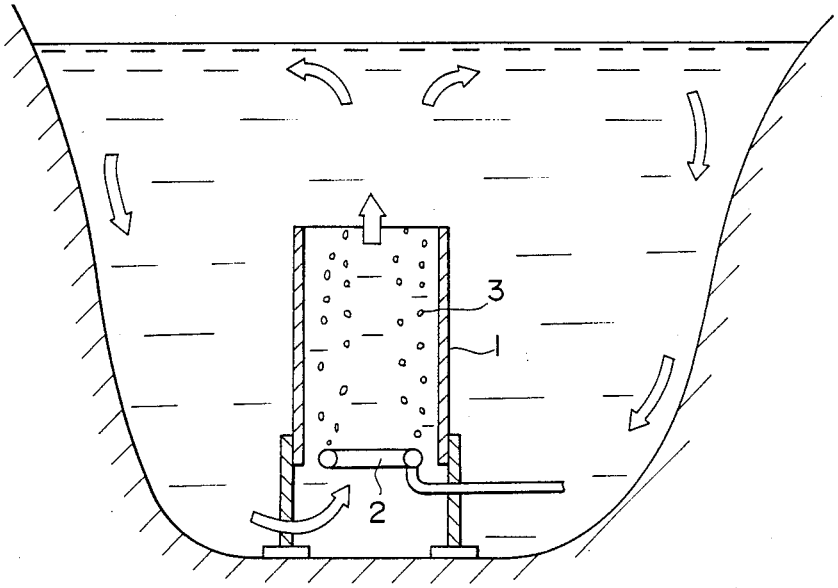
FIGURE 11 PRIOR ART
FIG. 11 is a schematic vertical cross-sectional view showing a conventional continuous aerator.
Figure 12:
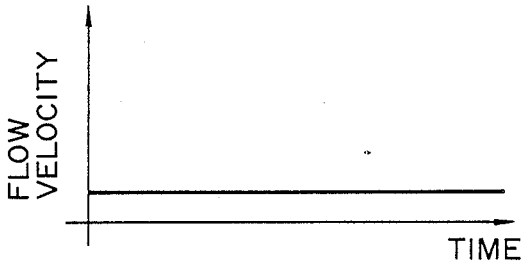
FIGURE 12 PRIOR ART
FIG. 12 is a graph showing the flow velocity of water lifted by the aerator shown in FIG. 11.
Figure 13:
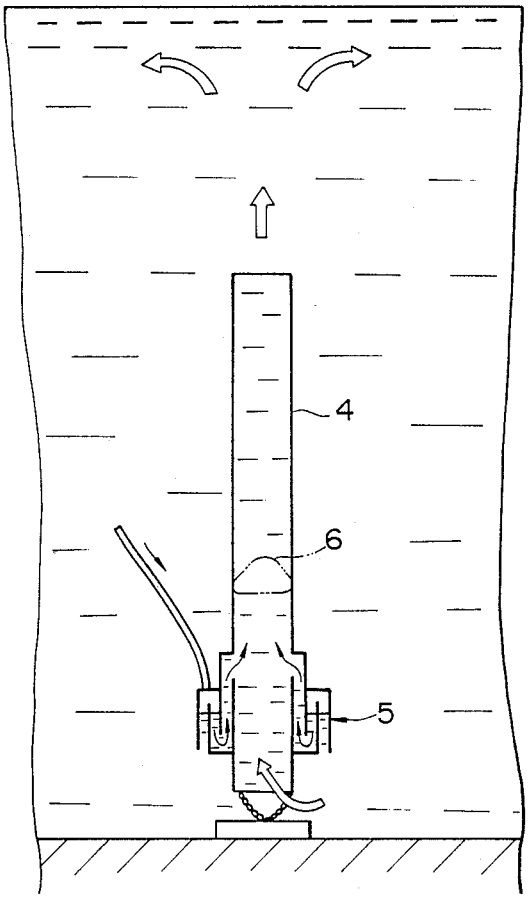
FIGURE 13 PRIOR ART
FIG. 13 is a schematic vertical cross-sectional view of a conventional intermittent aerator.
Figure 14:
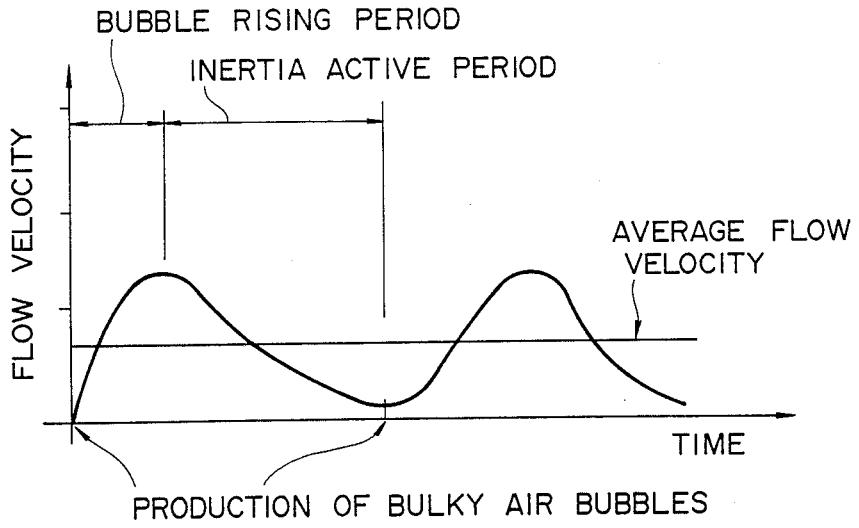
FIG. 14 and 15 are graphs illustrative of a problem concerning the flow velocity of water in the aerator shown in FIG. 13.
Figure 15:
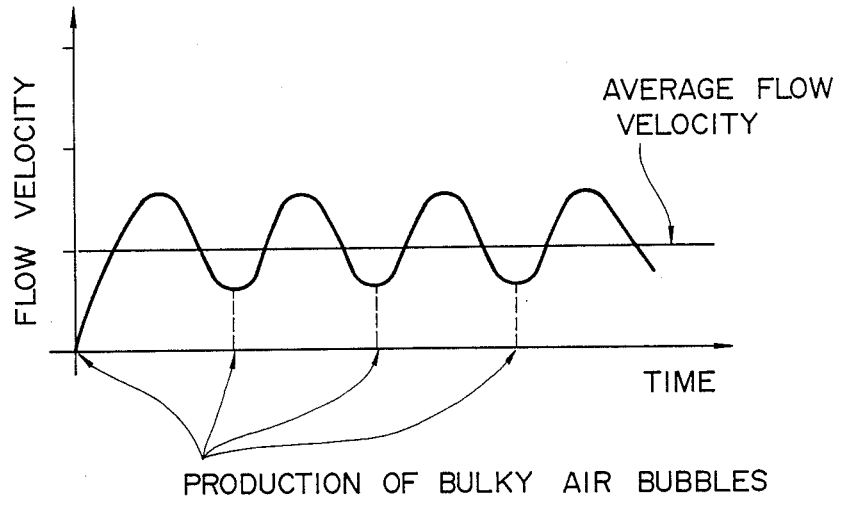
FIGURE 15 PRIOR ART
Figure 16A:
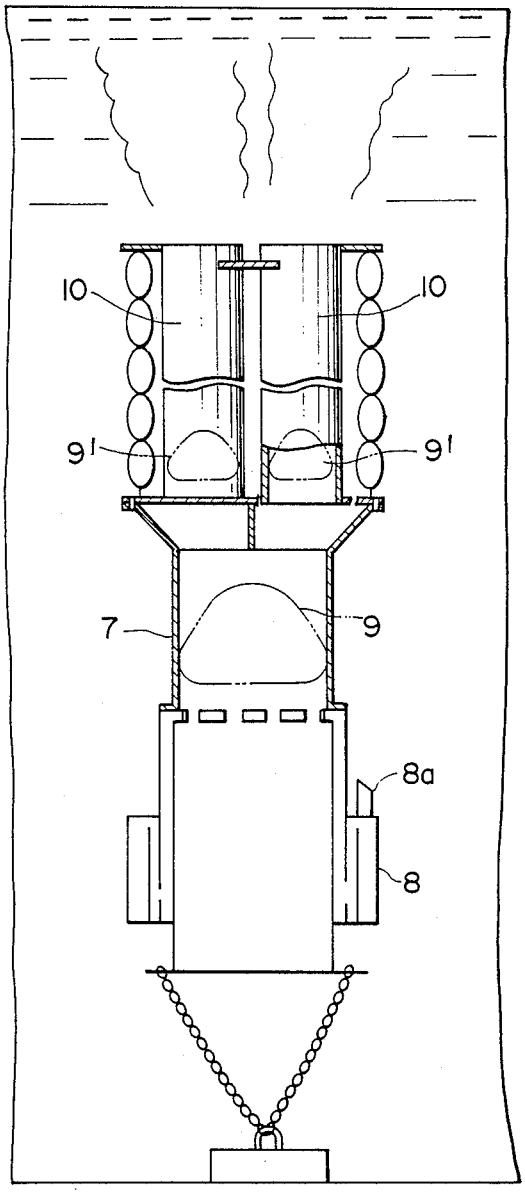
FIGURE 16A PRIOR ART
FIG. 16A is a schematic vertical cross-sectional view of another conventional intermittent aerator.
Figure 16B:
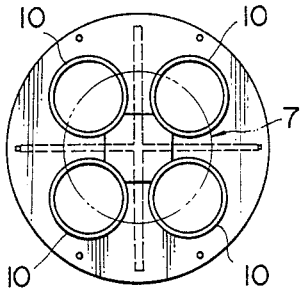
FIGURE 16B PRIOR ART
FIG. 16B is a plan view of the aerator shown in FIG. 16A.

A modified multi-tubular uptake tube aaerator 72 shown in FIG. 10 includes a vertically extending central tube member 73 and an outer tube member 74 disposed concentrically around the central tube member 73. The central tube member 73 has an inside diameter set in a range of from about 200 mm to 1000 mm. The distance between the central and outer tube members 73, 74 is smaller than 80% of the maximum diameter of a bulky air bubble for reliable formation of a single ring-shaped bulky air bubble 75.

The aerator 72 further includes a diffuser 76 disposed beneath the central tube member 73 for forcing fine air bubbles 77 into the central tube member 73, and an air tank 78 disposed in a lower end portion of the outer tube member 74 for producing a torus or ring-shaped bulky air bubble 75 between the central and outer tube members 73, 74.

The diffuser 76 is disposed in an auxiliary central tube member 79 adjacent to the lower end thereof and is secured to a circular anchor support 80 connected to the lower end of the auxiliary central tube member 79. The auxiliary central tube member 79 has the same diameter as the central tube member 73 and is connected at its upper end to the lower end of the central tube member 73. The diffuser 76 is connected to one end of an air supply hose 81 for supplying compressed air into the uptake tube aerator 72.

The air tank 78 is disposed concentrically around the auxiliary central tube member 79 and includes a bottomed double tubular member 82 and a topped double tubular member 83 disposed concentrically around the bottomed tubular member 82. The bottomed tubular member 82 is composed of a lower portion 82*a* of the auxiliary central tube member 79, an outer tube 82*b* disposed concentrically around the lower portion 82*a*, and an annular bottom wall 82*c* disposed flatwise against the anchor support 80 and interconnecting the lower portion 82*a* and the outer tube 82*b*. The topped double tubular member 83 is composed of a pair of parallel spaced inner and outer tubes 83*a*, 83*b* disposed respectively around the lower portion 82*a* and the outer tube 8*b* with predetermined annular spaces formed therebetween, and an annular top wall 83*c* interconnecting the inner and outer tubes 82*a*, 82*b*. The lower end of the inner tube 83*a* is spaced from the bottom wall 82*c* to form a gate 84 which serves to form the ring-shaped bulky air bubbles 75. The annular space 85 which is defined between the auxiliary central tube member 79 and the inner tube 83*a* has an upper end disposed below the outer tube member 74 and opening toward a water inlet formed at the lower end of the outer tube member 74. An air hose 86 extends through the anchor support 80 into an annular space defined between the outer tubes 82*b*, 83*b* so that compressed air is supplied through the hose 86 into the tank 78.

The anchor support 80 is connected by a chain 87 to an anchor 88 firmly embedded in the bottom of the lake. The outer tube member 74 carries on its outer peripheral wall a number of floats 89 so that the uptake tube aerator 72 is upstanding in the water.

With this construction, compressed air supplied through the air hose 87 into the air tank 78 is stored in an upper part of the topped double tubular member 83 and the water level in this tubular member 83 is lowered gradually as the amount of air increases.

When the water level is lowered to the lower end of the inner wall 83*a*, the compressed air is instantaneously drawn under siphonage through the gate 84 and the annular space 85 into the outer tube member 74.

The compressed air thus drawn is formed into a ring-shaped bulky air bubble 75 between the central tube member 73 and the outer tube member 74. The water which is divided by the air bubble 75 into upper and lower water parts is moved upwardly as the air bubble 75 rises in and along the outer tube member 74. Consequently, the bottom water which has been introduced into the aerator 72 as indicated by the arrow A is lifted toward the surface of the lake and then activated as it is agitated with the surface water having a high dissolved oxygen content. During that time, compressed air is stored in the tank 78 in preparation for the formation of the next succeeding air bubble 75. The foregoing cycle of operation is repeated to produce a succession of ring-shaped bulky air bubbles 75 rising toward the surface layer of the lake.

Since the inside diameter of the central tube member 73 and the distance between the central tube member 73 and the outer tube member 74 are set in the afore-said condition, the successive air bubbles 75 are free from separation or breakage. Such air bubble 75 completely seals the outer tube member 74 to fully separate the inside water into upper and lower parts and is capable of lifting the inside water positively and efficiently.

Compressed air supplied through the air hose 81 to the diffuser 76 is continuously aerated in the form of fine air bubbles 77 continuously flowing upwardly in and along the central tube members 79, 73. The fine bubbles 77, as they move upwardly, cause neighboring water to be moved upwardly under the buoyancy of the fine bubbles 77, thereby producing an upward aerated flow in the central tube member 79, 73. The upward aerated flow thus produced will thrust and accelerate the ring-shaped air bubbles 75 after the latter have left from the uptake tube aerator 72. At the same time, the upward aerated flow also entrains the neighboring water to thereby produce a large current flow Y.

Due to the continuous upward flow, a considable improvement in the lifting ability of the intermittent uptake tube is obtained. Experimental results indicate that when 10% of the air supply to the air tank 78 was delivered to the diffuser 76 to effect a combined continuous and intermittent aeration, the mixing ability of the combined aeration was increased by 1.3 times the mixing ability of the intermittent aeration.

Given below is a comparison between the lifting ability $V_1$ of the double tubular uptake tube aerator 72 and the lifting ability $V_2$ of a conventional intermittent aerator with a single uptake tube having an inside diameter D.

When the inside diameter D of the central tube member 73 and the distance W between the central and outer tube members 73, 74 are set in the afore-said condition, the diameter D′ of the outer tube member 74 is determined by the following equation:

$$D' = D + 2W \leqq 2.6D$$

The ratio of $V_1$ to $V_2$ is obtained by the following equation:

$$\frac{V_1}{V_2} = \frac{\text{Projected area of ring-shaped bubble}}{\text{Projected area of spherical bubble}} = \frac{(D')^2 - D^2}{D^2} = 5.76$$

The ratio of the amount of air $v_1$ used in the double tubular uptake tube aerator 72 to the amount of air $v_2$ used in the sigle uptake tube aerator is obtained by the following equation:

$$\frac{v_1}{v_2} = \frac{\text{volume of ring-shaped bubble}}{\text{volume of sphrical bubble}} = \frac{\pi/4\ W^2 \times \times (D' + D)/2}{\pi/6\ D^3} = 5.4$$

It appears from the foregoing that the lifting ability of the aerator 72 increases 5.76 times as large as that of the single uptake tube aerator when the aerator 72 receives a supply of air which is 5.4 times as large as the supply to the single uptake tube aerator.

In case the double tubular uptake tube aerator 72 further employs continuous aeration, it is possible to obtain an amount of lift which is 7.5 times (i.e. $5.7 \times 1.3$) as great as the amount of lift of the single uptake tube when the aerator 72 receives an air supply which is 5.94 times (i.e. $5.4 \times 1.1$) as large as the air supply to the single uptake tube aerator.

Consequently, it is possible to replace a total of seven conventional single uptake tube aerators with a single double tubular uptake tube aerator 72, thereby enabling considable reduction in the cost of equipment.

A further advantage of the aerator 72 is that the air tank 78 disposed inside the lower portion of the outside tube member 74 has an annular gate 84 of a relatively small diameter disposed closer to the central tube member 79 than to the outer tube member 74. With this arrangement, the difference between the highest level and the lowest level of the gate 84 is relatively small even when the aerator 72 is set in an inclined disposition. It is therefore possible to prevent objectionable distortion of the ring-shaped air bubbles 75.

Obviously, various modifications and variations are of the present invention are possible in the light of the above teaching. It is therefoere to be understood that within the scope of the appended claims the invention may be practiced otherwise than as specifically described.

What is claimed is:

1. A pluri-tubular aerator, comprising:

a vertical inner tube member having a cylindrical space defined therein;

at least one outer tube member disposed concentrically with respect to said inner tube member and having an enlarged lower portion extending parallel along an upper portion of said inner tube member so as to define a channel between said enlarged lower portion of said outer tube and said upper portion of said inner tube member; and means for delivering externally supplied air into said cylindrical space defined in said inner tube and said hollow cylindrical space defined between said inner tube member and said outer tube member wherein said air delivering means comprises a diffuser disposed in said inner tube member adjacent a lower end thereof and means to deliver air to said channel for intermittently producing a bulky air bubble in said outer tube member.

2. A pluri-tubular aerator, comprising, a vertical central tube member having a cylindrical space defined therein;

at least one outer tube member disposed concentrically around said central tube member and defining a hollow cylindrical space therebetween and having an enlarged lower portion extending parallel along a portion of said central tube member so as to define a channel between said enlarged lower portion of said outer tube and said portion of said central tube member; and means for delivering externally supplied air into said cylindrical space defined in said central tube member and said hollow cylindrical space defined between said central tube member and said outer tube member wherein said air delivering means comprises a diffuser disposed in said central tube member adjacent to a lower end thereof, and an air tank disposed on a lower end portion of said outer tube member for intermittently producing a bulky air bubble in said outer tube member.

3. A pluri-tubular aerator according to claim 2, wherein said air tank includes a gate disposed closer to said central tube member than to said outer tube member.

4. A pluri-tubular aerator, comprising, a vertical central tube member having a cylindrical space defined therein;

at least one outer tube member disposed concentrically around said central tube member and defining a hollow cylindrical space therebetween and having an enlarged lower portion extending parallel along a portion of said central tube member so as to define a channel between said enlarged lower portion of said outer tube an said portion of said central tube member; and means for delivering externally supplied air into said cylindrical space defined in said central tube member and said hollow cylindrical space defined between said central tube member and said outer tube member wherein said air delivering means comprises a diffuser disposed in said central tube member adjacent a lower end thereof, an air tank disposed on a lower end portion of said outer tube member for intermittently producing a bulky air bubble in said outer tube member, and means for distributing air to said diffuser and said air tank.

* * * * *